US005297528A

United States Patent [19]

Mukai

[11] Patent Number: 5,297,528

[45] Date of Patent: Mar. 29, 1994

[54] EVAPORATION FUEL CONTROL APPARATUS FOR ENGINE

[75] Inventor: Takeshi Mukai, Shizuoka, Japan

[73] Assignee: Suzuki Motor Corporation, Shizuoka, Japan

[21] Appl. No.: 66,981

[22] Filed: May 25, 1993

[30] Foreign Application Priority Data

Jun. 30, 1992 [JP] Japan ..... 4-196211
Jun. 30, 1992 [JP] Japan ..... 4-196212

[51] Int. Cl.[5] ..... F02M 33/02

[52] U.S. Cl. ..... 123/518; 123/520; 137/587

[58] Field of Search ..... 123/516-521; 137/587

[56] References Cited

U.S. PATENT DOCUMENTS 4,304,206 12/1981 Hall ..... 123/518
4,796,593 1/1989 Woodcock et al. ..... 123/516
4,815,436 3/1989 Sasaki et al. ..... 123/520
4,872,439 10/1989 Sonoda et al. ..... 123/519
5,174,265 12/1992 Sekine ..... 123/520
5,215,132 6/1993 Kobayashi ..... 137/587
5,220,898 6/1993 Kidokoro et al. ..... 123/520
5,235,955 8/1993 Osaki ..... 123/520
5,237,979 8/1993 Hyodo et al. ..... 123/520

FOREIGN PATENT DOCUMENTS 2-130254 5/1990 Japan .

*Primary Examiner*—E. Rollins Cross
*Assistant Examiner*—Thomas N. Moulis
*Attorney, Agent, or Firm*—Flynn, Thiel, Boutell & Tanis

[57] ABSTRACT

An evaporation fuel control apparatus for an engine wherein a canister is disposed in an intermediate part of a control passage which communicates between an engine inlet passage and a fuel tank, and is adapted to draw and retain evaporated fuel therein. A pressure responsive valve is disposed at an intermediate part of the passage between the canister and fuel tank for controlling opening and closing of the passage.

6 Claims, 8 Drawing Sheets

EVAPORATION FUEL CONTROL APPARATUS FOR ENGINE

FIELD OF THE INVENTION

This invention relates to an evaporation fuel control apparatus for an engine, and particularly to an evaporation fuel control apparatus which has a canister disposed at an intermediate part of a passage for intercommunicating an inlet passage of an engine and a fuel tank and adapted to draw and retain evaporated fuel.

BACKGROUND OF THE INVENTION

Evaporation of fuel which leaks into the atmosphere from a fuel tank, a float chamber of a carburetor, etc. is one of the causes of air pollution and results in loss of fuel. Various techniques are known for preventing this problem from occurring. As one typical means for obviating such problem, there is an evaporation system in which evaporated fuel generated in a fuel tank, etc. is temporarily absorbed and retained in a canister having an absorbent therein, and the evaporated fuel absorbed and retained in this canister is purged and discharged so as to be supplied to the engine during the operation thereof.

One example of the evaporation fuel control apparatus for an engine of the type mentioned above is disclosed in Japanese Patent Early Laid-Open Publication No. Hei 2-130254. The evaporation fuel control apparatus disclosed in this Publication comprises a communication passage for intercommunicating a fuel tank and a canister, a stop valve for opening and closing this communication passage, and stop detection means for detecting the stopping of the engine or the stopping of the vehicle, drive means for opening the stop valve for a predetermined period of time from the time when the stopping of the engine or the stopping of the vehicle is detected, the stop valve being opened for a predetermined period of time, and evaporated fuel contained in the fuel tank being guided to the canister so as to be retained, thereby extensively restraining the amount of the evaporated fuel from being discharged to the atmospheric air from a fuel tank feed port even when a filler cap is opened during filling of the fuel tank.

An example of a conventional evaporation fuel control apparatus for an engine is shown in FIG. 1. In FIG. 1, the numeral 202 denotes an engine, 204 an air cleaner, 206 a throttle valve, 208 a surge tank, 210 an inlet passage, 212 a combustion chamber, 214 a discharge passage, and 216 a fuel tank, respectively. An evaporation fuel control apparatus 218 for the engine 202 comprises an air passage 220 which is communicated at one end thereof with the surge tank 208 associated with the inlet passage 210 of the engine 202, the other end of the air passage 220 being communicated with the fuel tank 216.

A canister 222 is disposed at an intermediate part of the air passage 220, the canister 222 being adapted for absorbing and retaining evaporated fuel therein. A stop valve 224 is disposed at an intermediate part of the air passage 220 for intercommunicating the canister 222 and the surge tank 208. This stop valve 224 is opened and closed by a control unit (not shown) so that the evaporated fuel absorbed and retained in the canister 222 can be removed and discharged from the canister 222 so as to be supplied to the combustion chamber 212 in accordance with an operating condition of the engine 202. Furthermore, a check valve 226 is disposed at an intermediate part of the air passage 220 for intercommunicating the canister 222 and the fuel tank 216. This check valve 226 is opened when the internal pressure of the fuel tank 216 is brought to be equal to or greater than a set pressure.

In the evaporation fuel control apparatus 218 thus constructed, heretofore, the check valve 226, which is operated to open when the internal pressure of the fuel tank 216 is equal to or greater than a set pressure higher than that of the atmospheric air, is provided taking into consideration an excessive filling of fuel into the fuel tank 216 during filling thereof, so that the internal pressure of the fuel tank 216 can be controlled to the set pressure. Owing to this arrangement, the internal pressure of the fuel tank 216 accumulates to the set pressure.

Therefore, for the supply of fuel to the fuel tank 216, when a fuel feed cap 232 is removed from a fuel feed port 230 of a fuel feed passage 228, the internal pressure of the fuel tank 216 accumulated at the set pressure is released, with the unfavorable result that the evaporated fuel is discharged into the atmosphere.

In an evaporation restriction anticipated to be employed from 1995 model year vehicles in the United States, the internal pressure of the fuel tank is restricted to a predetermined level, for example, 10 inch mm Ag or less, during the operation of the engine. Therefore, an evaporation fuel control apparatus for an engine which is capable of coping with this evaporation restriction is keenly demanded.

In order to obviate this inconvenience, there is known another device in which the internal pressure of the fuel tank 216 is controlled to be equal to or less than a predetermined pressure (for example, 10 inch mm Ag or lower), which is lower than the set pressure of the check valve 226, during the operation of the engine 202. However, if the set pressure obtained by opening the check valve 226 is set to a low level in order to control the internal pressure of the fuel tank 216 so as to be equal to or lower than the predetermined pressure, it gives rise to such inconvenience that the check valve 226 is opened during the supply of fuel to the fuel tank 216, with the result that an excessive filling of the fuel into the tank cannot be prevented.

According to one embodiment of the present invention, in order to obviate the above inconveniences, there is provided an evaporation fuel control apparatus for an engine comprising a canister disposed at an intermediate part of a passage for intercommunicating an inlet passage of an engine and a fuel tank, and adapted to draw and retain evaporated fuel, characterized by further comprising a first control passage for intercommunicating the fuel tank and the canister, a second control passage for intercommunicating the canister and the inlet passage, a pressure valve disposed at an intermediate part of the first passage, a first solenoid valve being provided at an intermediate part of the second passage, a communication passage for intercommunicating the inlet passage and the pressure control valve, a second solenoid valve disposed at an intermediate part of the communication passage, a fuel detection device such as a level gauge associated with the fuel tank and adapted to detect an amount of fuel, and a control for controlling the second solenoid valve so that the inlet pipe negative pressure acts on and opens the pressure control valve during operation of the engine, and the atmospheric air pressure acts on and closes the pressure control valve in accordance with a detection signal coming from the fuel detection device when the fuel level or internal pressure in the fuel tank is brought equal to or more than a predetermined amount.

By virtue of the embodiment of the invention thus constructed, during operation of engine, the negative pressure in the inlet passage acts on the pressure control valve through the second solenoid valve, and the pressure control valve is opened to bring the internal pressure of the fuel tank generally equal to the atmospheric air pressure. When the fuel in the fuel tank is brought equal to or more than a predetermined amount, the second solenoid valve is operated in accordance with the detection signal so as to cause the atmospheric air to act on the pressure control valve in order to cut off the communication between the fuel tank and the canister, thereby preventing an excessive filling of fuel when the tank is supplied with fuel.

According to another embodiment of the present invention, there is provided, in order to obviate the above inconveniences, an evaporation fuel control apparatus for an engine wherein an air passage is communicated at one end thereof with an inlet passage of an engine, the other end of the air passage being bifurcated into a first branch air passage and a second branch air passage, the first and second branch air passages being communicated with a fuel tank, a canister being disposed at an intermediate part of the air passage and adapted to draw and retain evaporated fuel, a stop valve being disposed at an intermediate part of the air passage between the canister and the inlet passage, a check valve being disposed at an intermediate part of the first branch air passage, the check valve being opened when pressure within the fuel tank is brought to be equal to or more than a predetermined set pressure, a control valve being disposed at an intermediate part of the second branch air passage, the control valve being opened during operation of the engine, a float valve being disposed at an opening within the fuel tank of the first branch air passage, the float valve being closed when the fuel tank is fully filled with fuel.

According to the present invention constructed according to this latter embodiment, since the control valve is opened to communicate the second branch air passage during the operation of the engine, the internal pressure of the fuel tank can be brought generally to the atmospheric air pressure. As a result, since the fuel is supplied to the fuel tank immediately after the stoppage of the engine, the internal pressure of the fuel tank is already generally equal to the atmospheric air pressure. When the fuel tank is filled with fuel as a result of the supply of fuel thereto, the float valve is closed. The fuel tank is fully filled with fuel with only an upper space thereof left vacant, and the further supply of the fuel to the tank is interrupted. As a result, the internal pressure of the fuel tank is kept controlled to be the set pressure as determined by the check valve. Furthermore, since the internal pressure of the fuel tank is already made generally equal to the atmospheric air pressure, fuel can be supplied to the tank even during operation of the engine.

DETAILED DESCRIPTION

One embodiment of the present invention will be described hereinafter in detail with reference to FIGS. 2–5.

Figure 1:
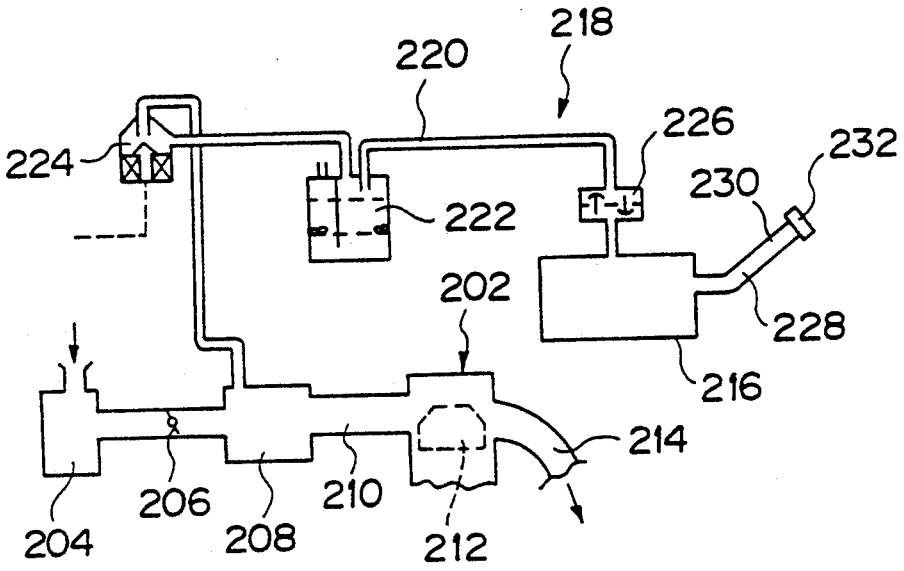
FIG. 1 PRIOR ART
FIG. 1 is a view of a general construction of an evaporation fuel control apparatus for an engine according to the prior art.
Figure 2:
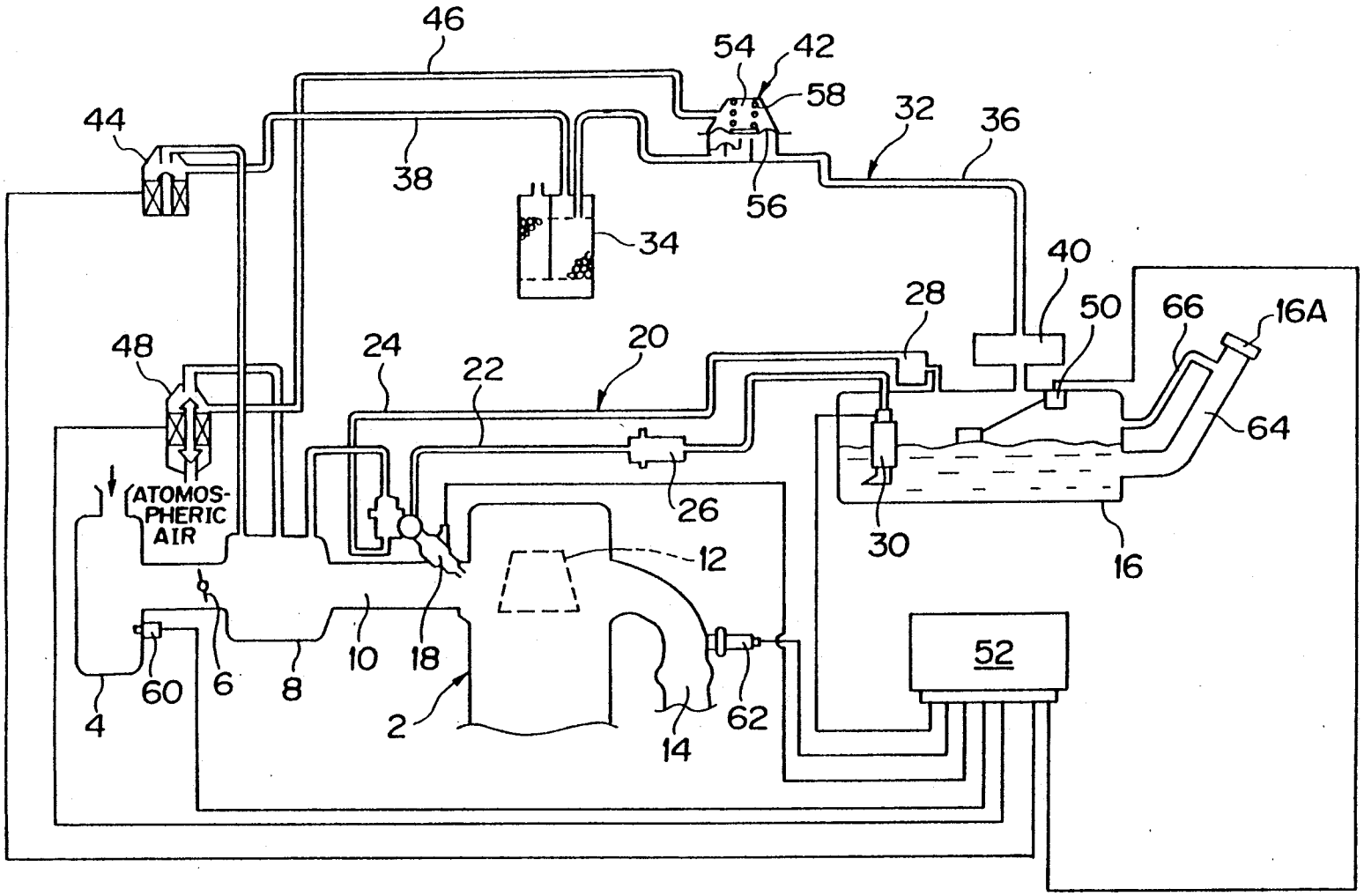
FIG. 2 is a view of a construction of an evaporation fuel control apparatus showing a first embodiment of the present invention.

In FIG. 2, the numeral 2 denotes an engine, 4 an air cleaner, 6 a throttle valve, 8 a surge tank, 10 an inlet passage, 12 a combustion chamber, 14 a discharge passage, and 16 a fuel tank, respectively. The engine 2 is provided at the inlet passage 10 with a fuel injection valve 18 oriented toward the combustion chamber 12. The fuel injection valve 18 is communicated with the fuel pump 16 by way of the fuel passage 20.

This fuel passage 20 is constituted by a fuel feed passage 22 for feeding fuel to the fuel injection valve 18, and a fuel return passage 24 for returning excess fuel to the fuel tank 16. The fuel feed passage 22 is provided at an intermediate part thereof with a filter 26, while the fuel return passage 24 is provided at an intermediate part thereof with a return volume 28.

The fuel in the fuel tank 16 is fed to the fuel injection valve 18 by the fuel pump 30 through the fuel feed passage 22, and then fed to the combustion chamber 12 for combustion with air. The exhaust generated by this combustion is discharged through the discharge passage 14.

The inlet passage 10 communicates with a passage 32, which passage communicates with the surge tank 8 on the downstream side of the throttle valve 6, and with the fuel tank 16. A canister 34 for drawing and retaining evaporated fuel is disposed at an intermediate part of this passage 32.

The passage 32 is constituted by a first passage 36 for intercommunicating the fuel tank 16 and the canister 34, and a second passage 38 for intercommunicating the canister 34 and the inlet passage 10.

The first passage 36 is provided at an intermediate part thereof with a check valve 40. The internal pressure of the fuel tank 16 and the internal pressure of the canister 34 are set respectively to predetermined pressure by this check valve 40 in order to restrain the amount of generation of evaporated fuel (HC) within the fuel tank 16.

The first passage 36 is provided at an intermediate part thereof with a pressure control valve 42, and the second passage 38 is provided at an intermediate part thereof with a first solenoid valve 44. Furthermore, a communication passage 46 for intercommunicating the inlet passage 10 and the pressure control valve 42 is provided. This communication passage 46 is provided at an intermediate part thereof with a second solenoid valve 48. A fuel level gauge 50 is disposed within the fuel tank 16 and adapted to detect the amount of fuel therein.

Furthermore, there is provided a control portion 52 adapted to control the second solenoid valve 48 to cause the inlet pipe negative pressure to act on the pressure control valve 42 so as to open the valve 42, and to operate the second solenoid valve 48 so as to cause the atmospheric air to act on the pressure control valve 42 in accordance with a detection signal coming from the fuel level gauge 50 when the fuel in the fuel tank 16 is brought equal to or greater than a predetermined amount.

More specifically, the above pressure control valve 42 is located at an intermediate part of the first passage 36 between the canister 34 and the check valve 40.

The above communication passage 46 is disposed in such a manner as to be opened at an upstream side portion thereof to the inlet passage 10, and at its other end is communicated with a pressure chamber 54 of the pressure control valve 42.

The pressure valve 42 is disposed such that a diaphragm 56 is urged by the bias of a spring 58 to close the pressure valve 42. The bias of the spring 58 is adjusted to open the pressure control valve 42 when the internal pressure of the fuel tank 16 is brought equal to or greater than a predetermined set value, and a check valve function is provided by the pressure control valve 42.

Figure 3:
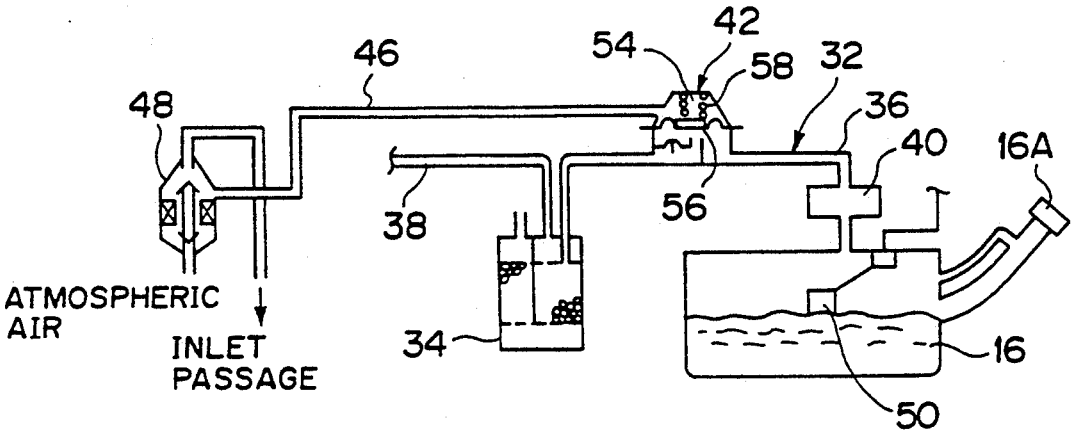
FIG. 3 is a schematic view of the evaporation fuel control apparatus of FIG. 2 during the operation of an engine.

As shown in FIG. 3, during the operation of the engine 2, the control portion 52 controls the second solenoid valve 48 to cause the inlet pipe negative pressure to act on the pressure control valve 42 so that the pressure control valve 42 is opened against the bias of the spring 58.

When the fuel in the fuel tank 16 is brought equal to or greater than a predetermined amount by the supply of fuel (that is, When the fuel tank 16 is fully filled), the control portion 52 controls such that the second solenoid valve 48 is operated in accordance with the detection signal coming from the fuel level gauge 50 in order to cause the atmospheric air to act on the pressure control valve 42.

The control portion 52 is connected with the fuel injection valve 18, the fuel pump 30, the first solenoid valve 44, the second solenoid valve 48, the fuel level gauge 50, an inlet temperature sensor 60 disposed within the air cleaner 4, and a discharge sensor 62 disposed at the discharge passage 14 and adapted to detect the concentration of oxygen.

The reference numeral 64 denotes a fuel hose for the fuel to pass through when the fuel is supplied to the fuel tank 16, and 66 is a breather hose for the fuel tank 16.

The operation of the embodiment of FIGS. 2–5 will now be described.

Figure 4:
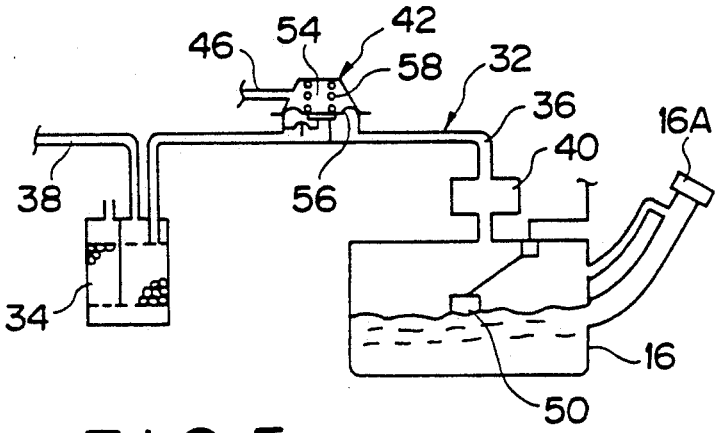
FIG. 4 is a schematic view of the evaporation fuel control apparatus of FIG. 2 during the stopped condition of the engine.

In the case where the engine 2 is stopped and the fuel tank 16 is not full of fuel, as shown in FIG. 4, the fuel level gauge 50 is not brought into an ON-state, the inlet passage negative pressure which is to act on the pressure chamber 54 of the pressure control valve 42 via the second solenoid valve 48 is not generated, and the communication between the fuel tank 16 and the canister 34 is cut off.

In the case where the internal pressure of the fuel tank 16 is brought equal to or greater than the predetermined set value when the engine 2 is in a stopped condition, the pressure control valve 42 is opened against the bias of the spring 58, and the internal pressure of the fuel tank 16 is bought down lower than the set value by the check valve function of the pressure control valve 42.

As shown in FIG. 3, during operation of the engine 2 in an idling condition, the inlet pipe negative pressure acts on the pressure chamber 54 of the pressure control valve 42 via the second solenoid valve 48 to open the pressure control valve 42 against the bias of the spring 58, and the fuel tank 16 and the canister 34 are in a communicated condition.

Figure 5:
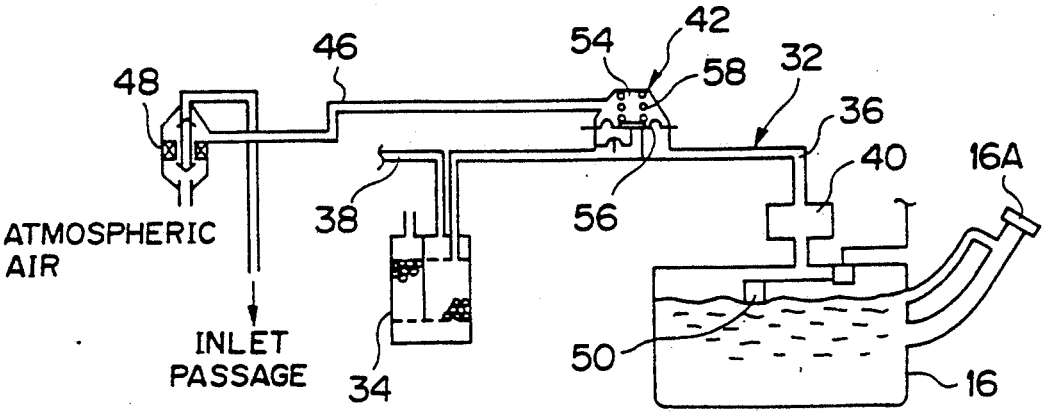
FIG. 5 is a schematic view of the evaporation fuel control apparatus of FIG. 2 during the operation of the engine and during the supply of the fuel.
Figure 6:
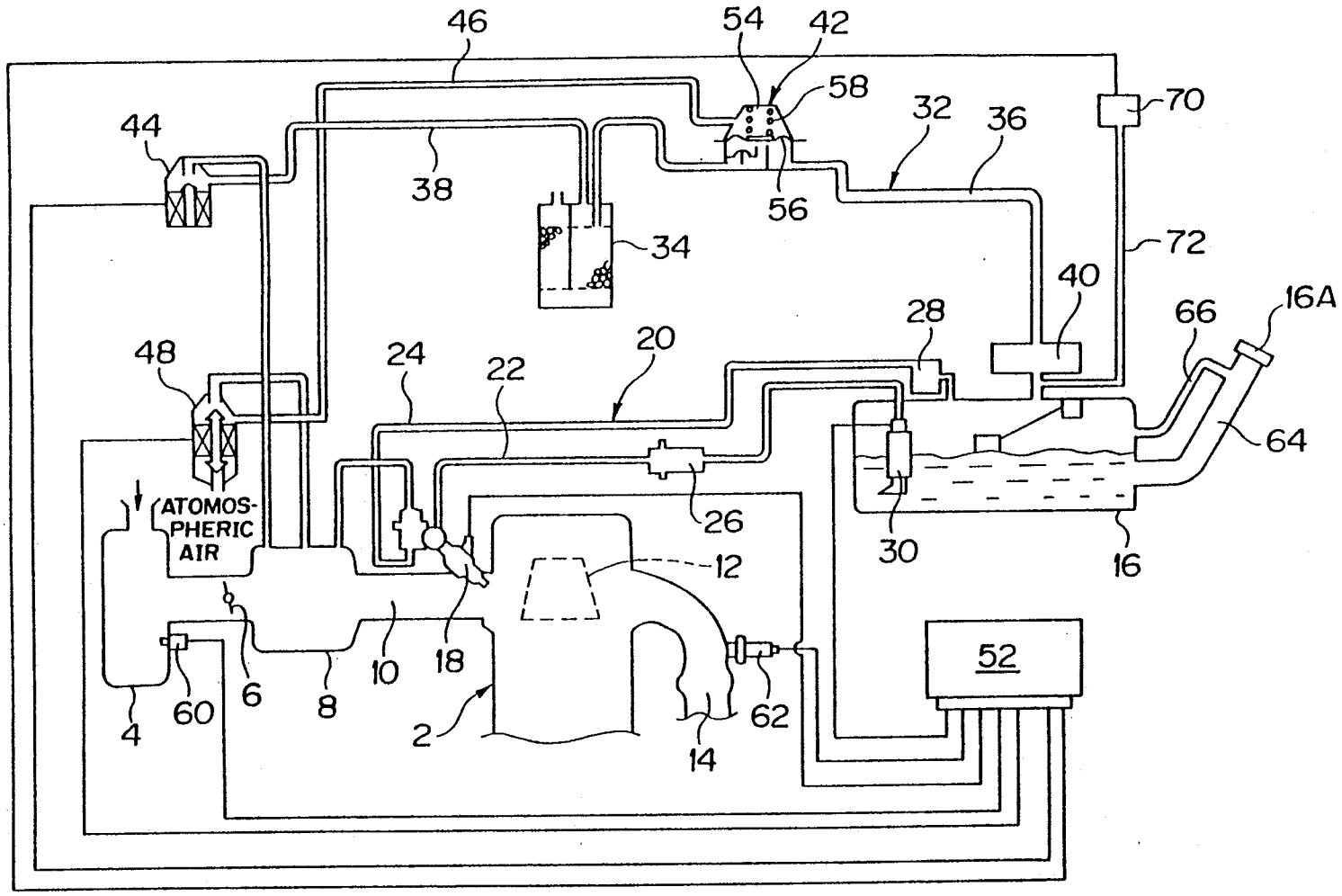
FIG. 6 is a view of a construction of an evaporation fuel control apparatus for an engine showing a second embodiment of the present invention.

Furthermore, during the operation of the engine 2 and during the supply of fuel, the inlet pipe negative pressure is acted on the pressure chamber 54 of the pressure control valve 42 via the second solenoid valve 48. And when the fuel tank 16 is fully filled, as shown in FIG. 5, the detection signal from the fuel level gauge 50 is inputted into the control portion 52, and the second solenoid valve 48 is caused to be opened to the atmospheric air in accordance with the control signal from the control portion 52. The atmospheric air acts on the pressure chamber 54 of the pressure control valve 42 to cut off the communication between the fuel tank 16 and the canister 34.

When the second solenoid valve 48 is returned so that the pressure chamber 54 of the pressure control valve 42 is again brought into communication with the inlet passage 10, the lowering of the amount of fuel in the tank 16 is detected by the fuel level gauge 50, the detection signal is inputted into the control portion 52, and a control signal is outputted to the second solenoid valve 48 from the control portion 52.

By doing so, the communication between the fuel tank 16 and the canister 34 can be cut off during the stopped condition of the engine 2, and when the internal pressure of the fuel tank 16 is brought equal to or greater than the predetermined set value during the stopped condition of the engine 2, the pressure control valve 42 can be opened against the bias of the spring 58. Moreover, the internal pressure of the fuel tank 16 can be brought lower than the set value owing to the check valve function of the pressure control valve 42, and even when a cap 16A of the fuel tank 16 is opened during the supply of fuel at a fuel supply site such as a gasoline station or the like, there is no fear that the internal pressure of the fuel tank 16 is released to the atmospheric air. The evaporated fuel (HC) in the fuel tank 16 is not discharged to the atmospheric air and the cause for air pollution is obviated.

Since the fuel tank 16 and the canister 34 can be communicated with each other during the operation of the engine 2, the internal pressure of the fuel tank 16 can be brought generally equal to the atmospheric air. As a result, even if fuel is supplied during the stopped condition of the engine after the vehicle is moved to a fuel supply site such as a gasoline station or the like, there is no fear that the internal pressure of the fuel tank 16 is released to the atmospheric air.

Furthermore, during the operation of the engine 2 and during the supply of fuel, first, when the pressure control valve 42 is opened to fully fill the fuel tank 16, the second solenoid valve 48 can be opened to the atmospheric air in accordance with the control signal coming from the control portion 52 to which the detection signal from the fuel level gauge 50 is inputted. Accordingly, when the fuel tank 16 is fully filled with fuel, the atmospheric air is acted on the pressure chamber 54 of the pressure control valve 42, and the communication between the fuel tank 16 and the canister 34 is cut off, thereby preventing excessive filling of fuel during the supply of fuel to the tank.

FIGS. 6–9 show a second embodiment of the present invention, and portions thereof exhibiting the same functions as the above-mentioned first embodiment are respectively represented by the same reference numerals.

The feature of this second embodiment resides in the fact that a pressure sensor 70 for detecting the internal pressure of the fuel tank 16 is provided for emitting a control signal instead of the fuel level gauge of the first embodiment.

More specifically, the inlet passage 10 communicates with the passage 32, which passage intercommunicates with the surge tank 8 on the downstream side of the throttle valve 6, and with the fuel tank 16. A canister 34 for drawing and retaining evaporated fuel is disposed at an intermediate part of this passage 32.

The above passage 32 is constituted by a first passage 36 for intercommunicating the fuel tank 16 and the canister 34, and a second passage 38 for intercommunicating the canister 34 and the inlet passage 10.

A check valve 40 is disposed at an intermediate part of the first passage 36. The internal pressure of the fuel tank 16 and the internal pressure of the canister 22 are set respectively to a predetermined pressure by this check valve 40, and the amount of generation of evaporated fuel (HC) in the fuel tank 16 is restrained.

Furthermore, the pressure sensor 70 is communicated between the fuel tank 16 of the first passage 36 and the check valve 40 through a pressure passage 72.

A pressure control valve 42 is disposed at an intermediate part of the first passage 36, a first solenoid valve 44 is disposed at an intermediate part of the second passage 38, a communication passage 46 for intercommunicating the inlet passage 10 and the pressure control valve 42 is provided, and a second solenoid valve 48 is disposed at an intermediate part of this communication passage 46.

There is provided a control portion 52 adapted to control such that, during the operation of the engine 2, the inlet pipe negative pressure passes through the valve 48 and acts on and opens the pressure control valve 42. When the internal pressure of the fuel tank 16 is brought equal to or greater than, for example, a predetermined value, the second solenoid valve 48 is operated in accordance to a detection signal from the pressure sensor 70 to cause the atmospheric air to be acted on the pressure control valve 42.

The control portion 52 is connected respectively with a fuel injection valve 18, a fuel pump 30, the first solenoid valve 44, the second solenoid valve 48, an inlet temperature sensor 60 disposed within an air cleaner 4, a discharge sensor 62 disposed within a discharge passage 14 and adapted to detect the concentration of oxygen, and the pressure sensor 70.

Figure 8:
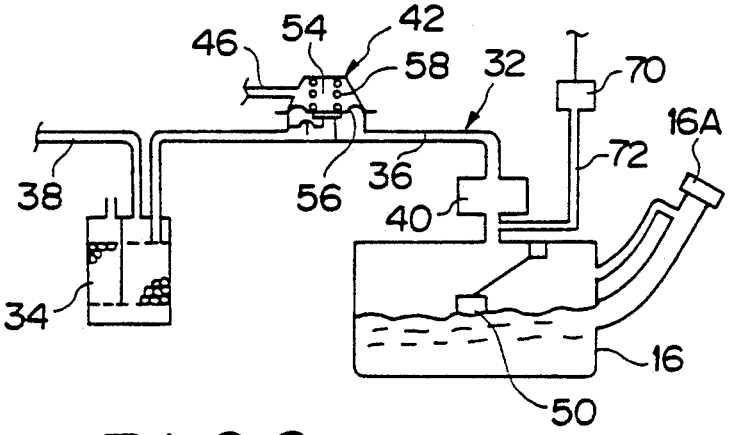
FIG. 8 is a schematic view of the evaporation fuel control apparatus of FIG. 6 during the stopped condition of the engine.
Figure 9:
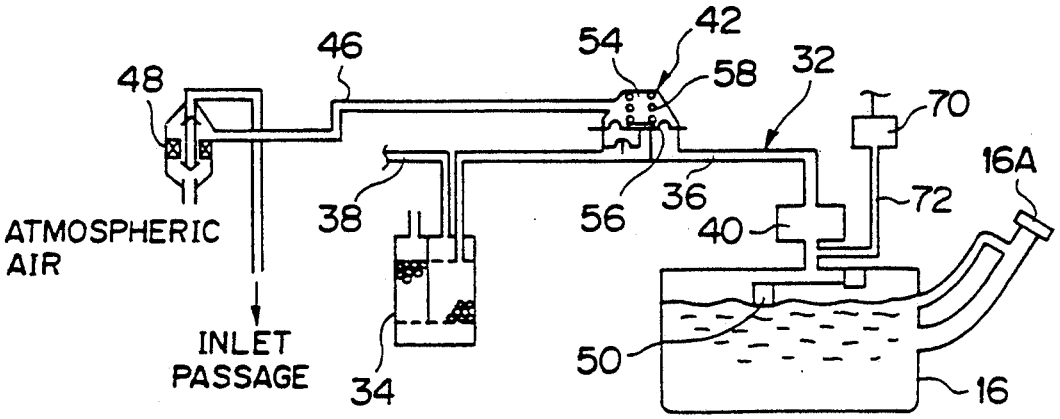
FIG. 9 is a schematic view of the evaporation fuel control apparatus of FIG. 6 during the operation of the engine and during the supply of fuel.

Owing to the above-mentioned arrangement, as shown in FIG. 8, the communication between the fuel tank 16 and the canister 34 can be cut off during the stopped condition of the engine 2. And when the internal pressure of the fuel tank 16 is brought equal to or greater than a predetermined set value during the stopped condition of the engine 2, the pressure control valve 42 can be opened against the bias of a spring 58. Furthermore, as in the above-mentioned first embodiment, the internal pressure of the fuel tank 16 can be brought to lower than the set value owing to the check valve function of the pressure control valve 42, and even when a cap portion 16A of the fuel tank 16 is opened during the supply of fuel at a fuel supply site such as a gasoline station or the like, there is no fear that the internal pressure of the fuel tank 16 is released to the atmospheric air. Furthermore, evaporated fuel (HC) in the fuel tank 16 is not discharged to the atmospheric air, and the cause for air pollution is obviated.

Figure 7:
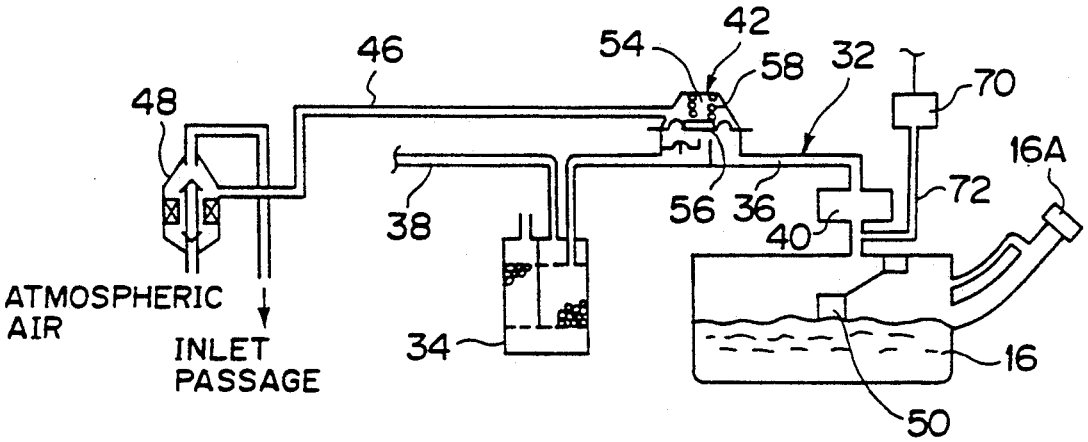
FIG. 7 is a schematic view of the evaporation fuel control apparatus of FIG. 6 during the operation of the engine.

As shown in FIG. 7, since the fuel tank 16 and the canister 34 can be communicated with each other during the operation of the engine 2, the internal pressure of the fuel tank 16 can be brought generally equal to the atmospheric pressure. As a result, even if fuel is supplied during the stopped condition of the engine after the vehicle is moved to a fuel supply site such as a gasoline station or the like, there is no fear that the internal pressure of the fuel tank 16 is released to the atmospheric air.

Furthermore, during the operation of the engine 2 and during the supply of fuel, first, when the pressure control valve 42 is opened to fully fill the fuel tank 16, the internal pressure of the fuel tank 16 is abruptly increased due to increase of the amount of supply of the fuel, and when the internal pressure of the fuel tank 16 is brought equal to or more than the predetermined value, the second solenoid valve 48 can be opened to the atmospheric air in accordance with the control signal coming from the control portion 52 to which a detection signal from the pressure sensor 70 is inputted, and therefore, the atmospheric air is acted on the pressure chamber 54 of the pressure control valve 42 when the internal pressure of the fuel tank 16 is brought equal to or more than the predetermined value. As a result, the communication between the fuel tank 16 and the canister 34 is cut off, thereby preventing the excessive filling of fuel during the supply of fuel.

The present invention is not limited to the above-mentioned first and second embodiments, but various modifications can be made.

For example, in the first and second embodiments of the present invention, although the fuel level gauge and the pressure sensor are employed in order to detect the fully filled condition of the fuel tank, a sensor for detecting the weight of fuel or other sensors may be employed as long as they can detect the fully filled condition of the fuel tank.

As described in the foregoing, according to the present invention, a passage is constituted by a first passage for intercommunicating the fuel tank of the engine and the canister, and a second passage for intercommunicating the canister and the inlet passage. The first passage is provided at an intermediate part thereof with a pressure control valve, and the second passage is provided at an intermediate part thereof with a first solenoid valve. Furthermore, a communication passage for intercommunicating the inlet passage and the pressure control valve is provided. This communication passage is provided at an intermediate part thereof with a second solenoid valve. A fuel level gauge is disposed within the fuel tank and adapted to detect the amount of fuel. Furthermore, there is provided a control portion adapted to control the second solenoid valve to cause the inlet pipe negative pressure to be acted on the pressure control valve so as to be opened, and to operate the second solenoid valve so as to cause the atmospheric air to be acted on the pressure control valve in accordance with a detection signal coming from the fuel level gauge when the fuel in the fuel tank is brought equal to or more than a predetermined amount. Accordingly, the fuel tank and the canister can be communicated with each other during the operation of the engine. Since the internal pressure of the fuel tank can be brought generally equal to the atmospheric air, there is no fear at all that the internal pressure of the fuel tank is opened to the atmospheric air during the supply of fuel. Furthermore, during the operation of the engine and during the supply of fuel first, when the pressure control valve is opened to fully fill the fuel tank, the second solenoid valve can be opened to the atmospheric air in accordance with the control signal coming from the control portion into which the detection signal from the fuel level gauge is inputted. Accordingly, the atmospheric air is acted on the pressure chamber, and the communication between the fuel tank 16 and the canister 34 is cut off, thereby preventing the excessive filling of fuel during the supply of fuel. Furthermore, if the check valve function is applied to the pressure control valve, the communication between the fuel tank and the canister can be cut off during the stopped condition of the engine, and when the internal pressure of the fuel tank is brought equal to or more than the predetermined set value during the stopped condition of the engine, the pressure control valve can be opened owing to the check valve function. As a result, the internal pressure of the fuel tank can be brought below the set value owing to this check valve function, and therefore, even if the cap of the fuel tank is opened during the supply of fuel, there is no fear that the internal pressure of the fuel tank is opened to the atmospheric air. Furthermore, the evaporation fuel (HC) in the fuel tank is not discharged to the atmospheric air, and the cause for air pollution can be obviated. Therefore, this is advantageous in view of practical use.

Figure 10:
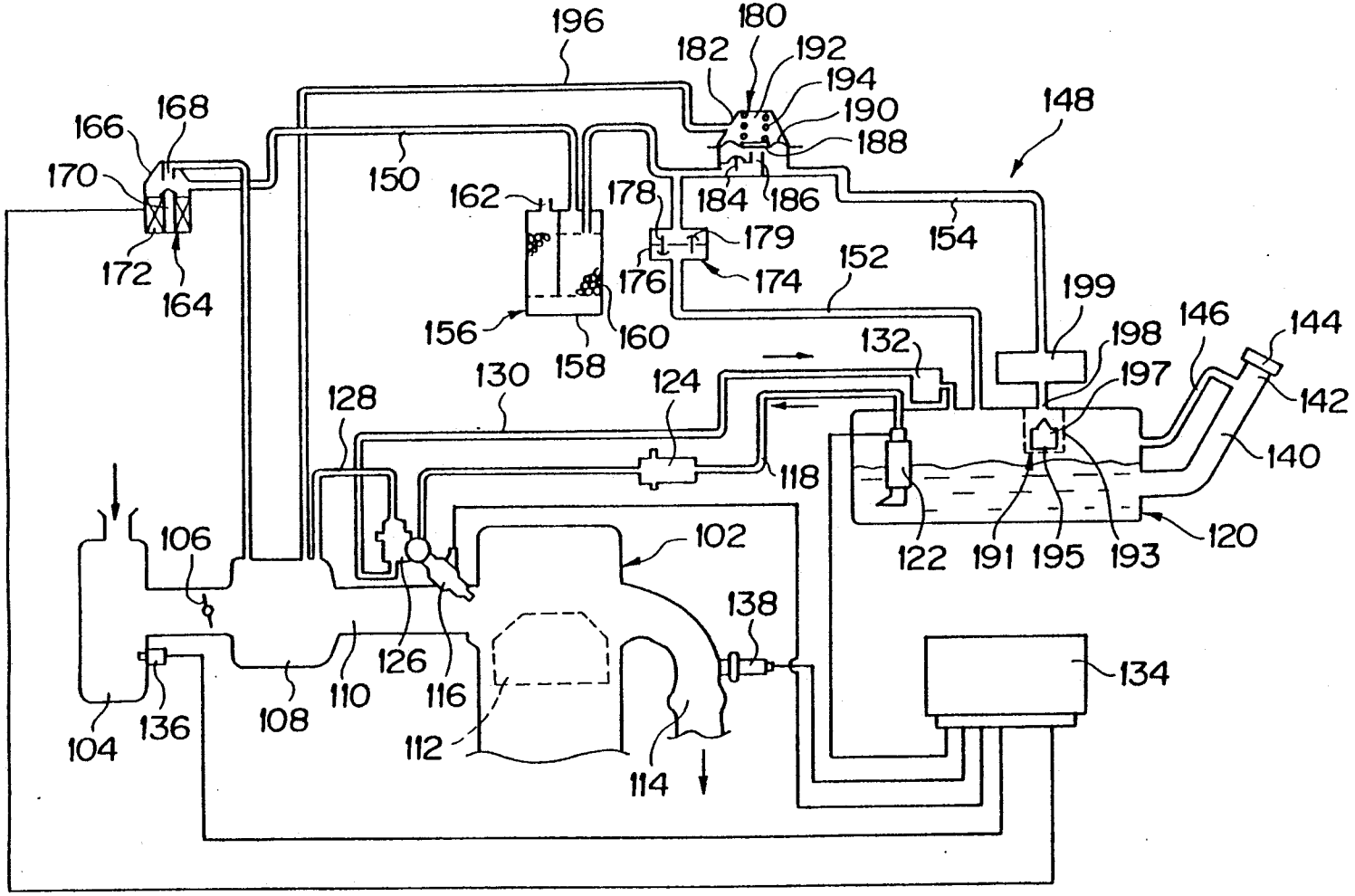
FIG. 10 is a view of a general construction of an evaporation fuel control apparatus showing a third embodiment of the present invention.

FIGS. 10–13 show a third embodiment of the present invention. In FIG. 10, the numeral 102 denotes an engine, 104 an air cleaner, 106 a throttle valve, 108 a surge tank, 110 an inlet passage, 112 a combustion chamber, 114 a discharge passage, and 116 a fuel injection valve, respectively. The engine 102 is provided at the inlet passage 110 with the fuel injection valve 116 oriented toward the combustion chamber 112. The fuel injection valve 116 is communicated with a fuel pump 122 of a fuel tank 120 by way of a fuel feed passage 118. A fuel filter 124 is disposed at an intermediate part of the fuel feed passage 118.

The fuel fed to the fuel injection valve 116 is regulated in pressure by a fuel pressure regulator 126. The fuel pressure regulator 126 regulates the fuel pressure by the pressure of the inlet passage 110 introduced by a regulation pressure introduction passage 128 and returns surplus fuel to the fuel tank 120 by way of a fuel return passage 130. The numeral 132 denotes a return fuel tank adapted to temporarily store the returned fuel.

The fuel injection valve 116 is connected to a control unit 134 as a control means. This control unit 134 is connected with an air sensor 136, an oxygen sensor 138, etc. This control unit 134 is adapted to control the action of the fuel injection valve 116 in accordance with detection signals inputted from these sensors 136 and 138, etc. in order to obtain a required fuel-air ratio.

A fuel feed passage 140 is communicated at one end thereof with the fuel tank 120. A fuel feed cap 144 is removably attached to a fuel feed portion 142 at the other end thereof. A breather passage 146 is communicated at one end thereof with the fuel tank 120, and the other end of the breather passage 146 is communicated with the vicinity of the fuel feed port 142 of the fuel feed passage 140.

The engine 102 is provided with an evaporation fuel control apparatus 148. This evaporation fuel control apparatus 148 is provided with an air passage 150 which is communicated at one end thereof with the surge tank 108 on, for example, a downstream side of the throttle valve 106. The other end of the air passage 150 is bifurcated into a first branch air passage 152 and a second branch air passage 154. These first and second branch air passages 152 and 154 are communicated with the fuel tank 120.

A canister 156 is disposed at an intermediate part of the air passage 150, and adapted to absorb and retain evaporated fuel. The canister 156 has a case 158 containing an absorbent 160 and communicating with an atmospheric air passage 162. That intermediate part of the air passage 150, as it extends from the inlet passage 110 to the canister 156, is provided with a stop valve 164. This stop valve 164 is provided with a valve element 170 adapted to open and close a valve port 168 disposed at an intermediate part of the air passage 150 within the stop valve body 166, and with a solenoid 172 adapted to open and close this valve element 170. The stop valve 164 is connected to the control unit 134. The control unit 134 opens and closes the stop valve 164 by means of a duty control signal, so that the evaporated fuel absorbed and retained in the canister 156 is supplied to the combustion chamber 112 so as to be burnt in accordance with the operating condition of the engine 102.

A check valve 174 is disposed in an intermediate part of the first branch air passage 152. The check valve 174 is opened when the internal pressure of the fuel tank 120 is brought to be equal to or greater than a set pressure. This check valve 174 is constituted by a two-way valve having two non-return valves 178 and 179 which are placed in the check valve body 176 in such a manner as to be oriented in opposite directions with each other.

The second branch air passage 154 is provided at an intermediate part thereof with a control valve 180 which is opened during the operation of the engine 102. The control valve 180 comprises a non-return valve 184 for permitting the fuel to be flowed to the fuel tank 120 side, and a valve port 186 oriented toward the fuel tank 120, which are disposed at an intermediate part of the second branch passage 154 within the control valve body 182. The control valve 180 also includes a valve element 188 supported by a diaphragm 190 and adapted to open and close the valve port 186, a spring 194 disposed in a pressure chamber 192 defined by the diaphragm 190 and adapted to urge the valve element 188 against the valve port 186, and a pressure introduction passage 196 for intercommunicating the pressure chamber 192 and the surge tank 108 as disposed on the downstream side of the throttle valve 106.

Owing to the above arrangement, the control valve 180 is opened by a negative pressure of the inlet passage 110 acting on the pressure chamber 192 during the operation of the engine 102. The valve port 186 and valve element 188 of the control valve 180 are set in such a manner as to be opened when the internal pressure of the fuel tank 120 is brought to be equal to or greater than the set pressure and have a function to act as a check valve.

A float valve 191 is disposed at an opening 198 in the fuel tank 120 of the second branch air passage 154 and is adapted to be closed when the fuel tank 120 is fully filed with fuel. The float valve 191 comprises a gauge-like float valve body 193, a valve element 195 held in the float valve body 193 for movement toward the opening 198, and a projection portion 197 disposed on the valve element 195 and adapted to open and close the opening 198. The numeral 199 denotes a separator disposed in the second branch air passage 154 located between the fuel tank and the control valve 180.

Operation of FIGS. 10–13 embodiment:

In the evaporation fuel control apparatus 148, the stop valve 164 is opened and closed by the control unit 134 through duty control during the Operation of the engine 102, in order to remove and discharge the evaporated fuel absorbed and retained in the canister 156 in accordance with the operating condition of the engine 102 so as to be supplied to the combustion chamber 112 for burning. In the evaporation fuel control apparatus 148, the stop valve 164 is closed by the control unit 134 during stoppage of the engine 102 so that the evaporation fuel generated in the fuel tank 120 is absorbed and retained in the canister 156.

Figure 11:
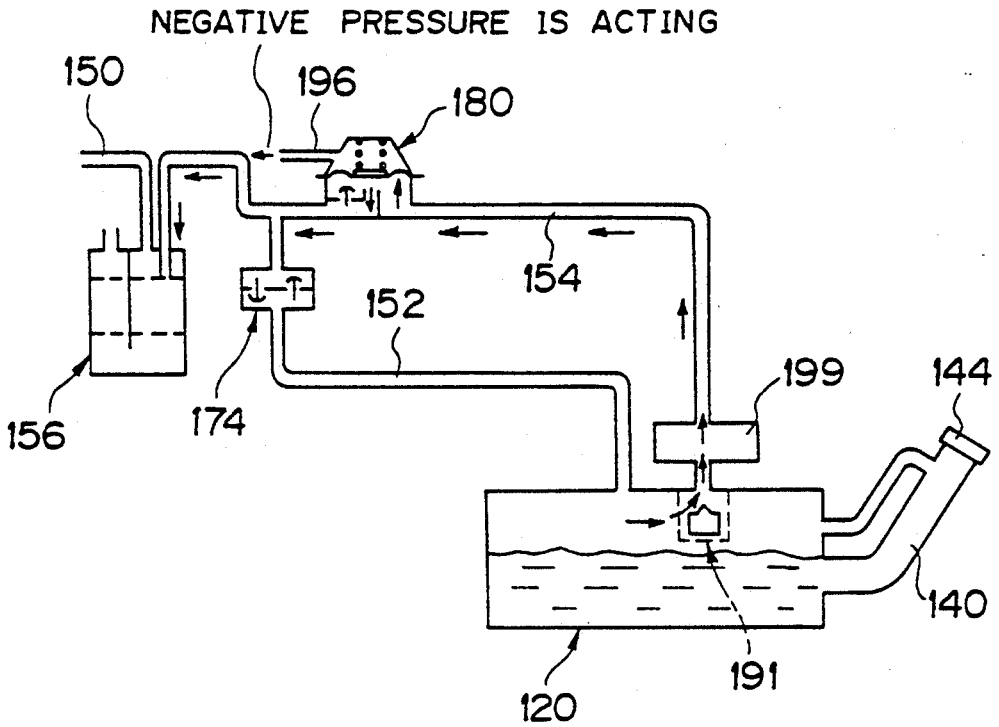
FIG. 11 is an explanatory view of the action of the evaporation fuel control apparatus of FIG. 10 during operation of the engine.

As shown in FIG. 11, in the evaporation fuel control apparatus 148, the negative pressure of the inlet passage 110 acts on the pressure chamber 192 of the control valve 180 during the operation of the engine 102, and the control valve 180 is opened so as to be communicated with the second branch air passage 154. By this arrangement, since the fuel tank 120 is communicated with the canister 156 through the second branch air passage 154 and the air passage 150, the internal pressure of the fuel tank 120 is brought to be generally equal to the atmospheric air pressure.

Figure 12:
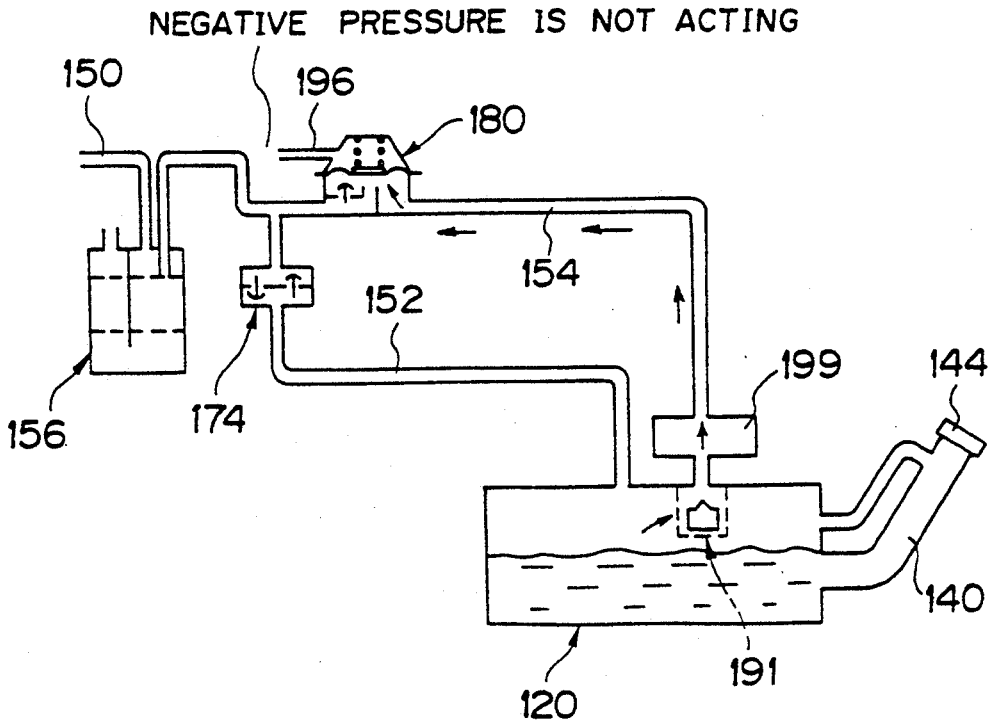
FIG. 12 is an explanatory view of the action of the evaporation fuel control apparatus of FIG. 10 during the stoppage of the engine.

As shown in FIG. 12, in the evaporation fuel control apparatus 148, when the engine 102 is stopped, the negative pressure of the inlet passage 110 does not act on the pressure chamber 192 of the control valve 180 any more, and the control valve 180 is closed to the second branch air passage 154. As a result, the communication of the fuel tank 120 with the canister 156 is cut off.

When the fuel is supplied to the fuel tank 120, the engine 102 is stopped. At that time, the internal pressure of the fuel tank 120 is already brought to be generally equal to the atmospheric air pressure which is available during the operation of the engine 102. Therefore, when the fuel feed cap 144 is removed from the fuel feed port 142 of the fuel feed passage 140 to permit filling of the tank with fuel, the evaporation fuel can be prevented from being discharged from the tank to the atmospheric air.

More specifically, when fuel becomes short during the operation of the engine 102, the vehicle is stopped at a gasoline service station or the like, and fuel is supplied into the tank only after the engine is stopped. Therefore, fuel is usually supplied to the tank immediately after the engine 102 is stopped. For this reason, the internal pressure of the fuel tank 120 at the time when fuel is supplied is already brought to be generally equal to the atmospheric air pressure available during the operation of the engine 102.

Accordingly, when the fuel feed cap 144 is removed from the fuel feed port 142 of the fuel feed passage 140 of the fuel tank 120, the evaporation fuel can be prevented from being discharged from the fuel tank 120 to the atmospheric air.

In the event a long time has passed since the stoppage of the engine 102 until the start of fuel filling, the internal pressure of the fuel tank 120 is sometimes increased. However, it is not an usual practice to immediately supply the fuel in the condition that the internal pressure of the fuel tank 120 is still high. Usually, the vehicle is moved to a gasoline service station or the like by operating the engine 102, and fuel is supplied only after the engine 102 is stopped. Therefore, as mentioned above, for the supply of fuel, since the internal pressure of the fuel tank 120 is already brought to be generally equal to the atmospheric air pressure available during the operation of the engine 102, even if the fuel feed cap 144 of the fuel tank 120 is removed, the evaporation fuel can be prevented from being discharged to the atmospheric air, thereby enabling prevention of air pollution.

When the fuel tank 120 is fully filled with fuel as the result of the supply of fuel, the float valve 191 is closed. As a result, the fuel tank 120 is cut off from its communication with the canister 156 with the upper space thereof left vacant, and an additional supply of fuel is interrupted. The internal pressure of the fuel tank 120 is kept controlled to the set pressure by the check valve 174 until the float valve 191 is opened. As a result, excessive filling of the fuel can be prevented, and the check valve 174 is opened to release the pressure when the internal pressure of the fuel tank 120 goes beyond the set pressure.

Figure 13:
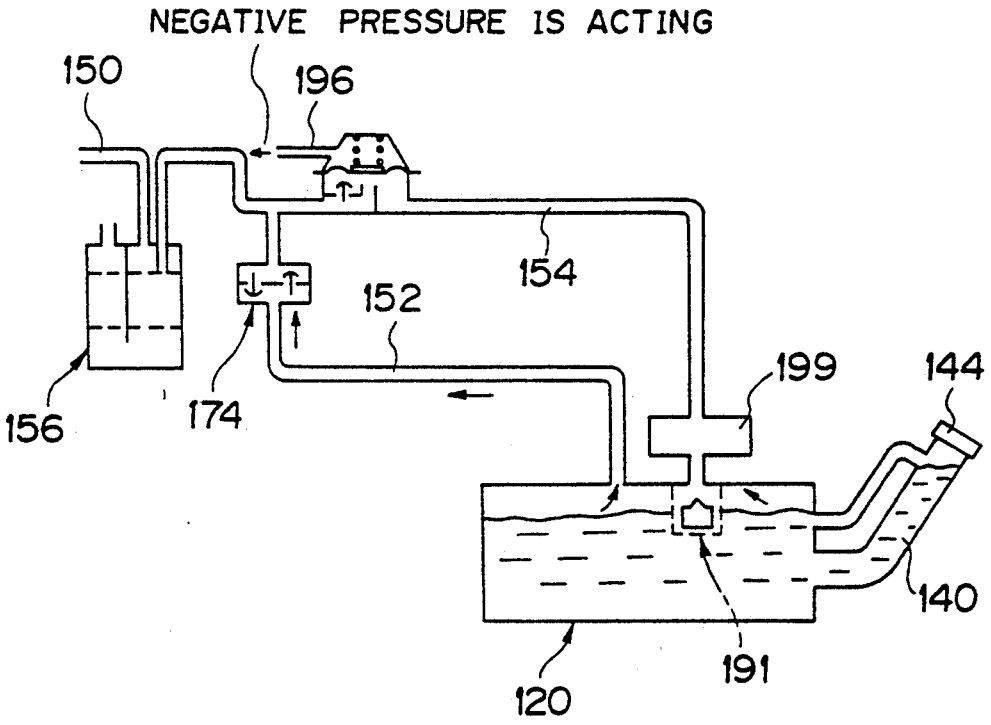
FIG. 13 is an explanatory view of the action of the evaporation fuel control apparatus of FIG. 10 when fuel is supplied during stoppage of the engine.

In the evaporation fuel control apparatus 148, as shown in FIG. 13, even when fuel is supplied to the fuel tank 120 during the operation of the engine 120 (for example, idle operation), the control valve 180 is already opened to bring the internal pressure of the fuel tank 120 to generally equal the atmospheric air pressure, and therefore even if the fuel feed cap 144 of the fuel tank 120 is removed, the evaporation fuel can be prevented from being discharged from the fuel tank 120 to the atmospheric air.

When the fuel tank 120 is fully filled with fuel as a result of the supply of fuel during the operation of the engine 120, the float valve 191 is closed. As a result, the fuel tank 120 is cut off from communication with the canister 156, and fully filled with fuel with the upper space thereof left vacant. As a result, an additional supply of fuel to the fuel tank 120 is interrupted, and the internal pressure of the fuel tank 120 is kept controlled to the set pressure by the check valve 174 until the float valve 191 is opened. Therefore, excessive filling of the fuel can be prevented, and when the internal pressure of the fuel tank 120 goes beyond the set pressure, the pressure can be released by the opening the check valve 174.

In this embodiment, since the control valve 180 is opened by the negative pressure of the inlet passage 110, the structure is simple. The control valve 180 may be constituted by an electromagnetic valve which is opened and closed by the control unit 134. In this way, a positive control can be obtained utilizing the existing control unit 134.

As apparent from the foregoing, according to this latter embodiment of the invention, when fuel is supplied to the fuel tank, the internal pressure of the fuel tank is already brought to be generally equal to the atmospheric air pressure. Accordingly, at the time when fuel is supplied to the fuel tank, the evaporation fuel can be prevented from being discharged to the atmospheric air from the fuel tank, and air pollution can be prevented. Furthermore, it is possible to meet with the requirement of the recent time in that the internal pressure of the fuel tank must be controlled to be equal to or lower than a predetermined pressure which is lower than the set pressure. The fuel tank is prevented from being supplied with additional fuel when the fuel tank is fully filled with fuel with the upper space thereof left vacant, and the internal pressure of the fuel tank is controlled to be the set pressure by the check valve. Accordingly, excessive filling of the fuel can be prevented, and when the internal pressure of the fuel tank goes beyond the set pressure, the pressure can be released by opening the check valve. Furthermore, fuel can be supplied even during the operation of the engine, and when the fuel tank is fully filled with fuel, the float valve is closed to permit the check valve to control the internal pressure of the fuel tank to the set pressure. Accordingly, even if fuel is supplied during the operation of the engine, excessive filling of the fuel can be prevented.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An evaporation fuel control apparatus for an engine comprising a canister disposed at an intermediate part of a control passage for communicating with an inlet passage of an engine and a fuel tank, the canister being adapted to draw and retain evaporated fuel, the control passage including a first passage for intercommunicating said fuel tank and said canister and a second passage for intercommunicating said canister and said inlet passage, said first and second passage constituting said control passage, a pressure control valve disposed at an intermediate part of said first passage, a first solenoid valve being provided at an intermediate part of said second passage, a communication passage for intercommunicating said inlet passage and said pressure control valve, a second solenoid valve disposed at an intermediate part of said communication passage, a fuel detection means associated with said fuel tank for detecting an amount of fuel therein, and a control means for permitting inlet passage negative pressure to act on and open said pressure control valve during operation of said engine and for causing operation of said second solenoid valve in accordance with a detection signal coming from said fuel detection means when the quantity of fuel in said fuel tank is brought equal to or more than a predetermined amount so that atmospheric air acts on and closes said pressure control valve.

2. In an evaporation fuel control system for an internal combustion engine, including an inlet passage connected to a combustion chamber of the engine, a canister for drawing and retaining evaporated fuel, a first control passage communicating between said inlet passage and said canister, a second control passage communicating between said canister and a fuel tank, and a first control valve means associated with said first control passage and being openable and closeable for controlling flow through said first control passage, the improvement comprising a second pressure-responsive control valve means associated with said second passage and movable between open and closed positions for controlling flow through said second passage, a third control passage providing communication between said inlet passage and said second pressure-responsive control valve means for maintaining said second control valve means in an open position allowing flow through said second control passage when negative pressure in the inlet passage is transmitted to the second control valve means through the third control passage, third control valve means associated with said third control passage for controlling communication of said third control passage with either said inlet passage or the surrounding atmosphere, said third control passage when communicating with the atmosphere providing atmospheric pressure to said second control valve means so as to cause closure thereof so that said second control passage is closed, fuel level detection means disposed within the fuel tank for detecting the quantity of fuel therein and for emitting a detection signal when the quantity of fuel in the tank equals or exceeds a predetermined amount, and control means responsive to said detection signal for connecting said third control valve means with the atmosphere so that atmospheric pressure is supplied through said third control passage to said second control valve means to cause closing of said second control passage.

3. A system according to claim 1, wherein the detection means senses the level of fuel in the tank and emits the detection signal upon sensing a predetermined level.

4. A system according to claim 2, wherein the detection means senses internal pressure of the fuel tank and emits the detection signal when the internal pressure equals or exceeds a predetermined value.

5. A system according to claim 2, including check valve means associated with said second control passage at a location between said canister and said fuel tank.

6. An evaporation fuel control apparatus for an engine, comprising an air passage communicating at one end thereof with an inlet passage of an engine, the other end of said air passage being bifurcated into a first branch air passage and a second branch air passage, said first and second branch air passages communicating with a fuel tank, a canister disposed at an intermediate part of said air passage and adapted to draw and retain evaporated fuel, a stop valve disposed at an intermediate part of said air passage between said canister and said inlet passage, a check valve disposed at an intermediate part of said first branch air passage, said check valve being opened when pressure within said fuel tank is brought equal to or greater than a predetermined set pressure, a control valve disposed at an intermediate part of said second branch air passage, said control valve being opened during operation of said engine, a float valve disposed within said fuel tank at an opening with said first branch air passage, said float valve being closed when said fuel tank is fully filled with fuel.

* * * * *